US008496321B2

(12) United States Patent
Kanbe

(10) Patent No.: US 8,496,321 B2
(45) Date of Patent: Jul. 30, 2013

(54) LIQUID CARTRIDGES

(75) Inventor: Tomohiro Kanbe, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 112 days.

(21) Appl. No.: 13/071,994

(22) Filed: Mar. 25, 2011

(65) Prior Publication Data

US 2011/0310196 A1 Dec. 22, 2011

(30) Foreign Application Priority Data

Jun. 17, 2010 (JP) ..... 2010-137870

(51) Int. Cl.
*B41J 2/175* (2006.01)

(52) U.S. Cl.
USPC ..... 347/86

(58) Field of Classification Search
None
See application file for complete search history.

(56) References Cited

U.S. PATENT DOCUMENTS

| | | | | |
|---|---|---|---|---|
| 6,015,209 | A * | 1/2000 | Barinaga et al. | 347/86 |
| 6,554,411 | B1 * | 4/2003 | Hatasa et al. | 347/86 |
| 6,666,542 | B2 * | 12/2003 | Yoshiyama et al. | 347/49 |
| 6,786,581 | B1 * | 9/2004 | Shinada et al. | 347/86 |
| 6,953,242 | B2 * | 10/2005 | Yoshiyama et al. | 347/86 |
| 7,152,954 | B2 * | 12/2006 | Katayama | 347/49 |
| 7,318,640 | B2 * | 1/2008 | Hattori et al. | 347/86 |
| 2006/0028517 | A1 * | 2/2006 | Ishizawa et al. | 347/86 |
| 2007/0070142 | A1 * | 3/2007 | Hattori et al. | 347/86 |
| 2012/0188315 | A1 * | 7/2012 | Kawate | 347/87 |

FOREIGN PATENT DOCUMENTS

JP 2001-071522 A 3/2001

* cited by examiner

*Primary Examiner* — Matthew Luu
*Assistant Examiner* — Michael Konczal
(74) *Attorney, Agent, or Firm* — Baker Botts L.L.P.

(57) ABSTRACT

A liquid cartridge includes a cartridge main body comprising a liquid chamber and an end surface. The liquid cartridge also includes a communicating portion protruding from the end surface of the cartridge main body in a protruding direction which is perpendicular to a width direction. The liquid chamber includes a wide portion and a narrow portion which is narrower than the wide portion in the width direction, and the narrow portion is offset toward a first side of the cartridge main body in the width direction. When the liquid cartridge is oriented such that the communicating portion faces downward and liquid is stored in the narrow portion, a position of center of gravity of the liquid cartridge is offset toward the first side of the cartridge main body from an area occupied by the communicating portion when the liquid cartridge is viewed in a vertical direction.

12 Claims, 11 Drawing Sheets

LIQUID CARTRIDGES

CROSS REFERENCE TO RELATED APPLICATION

The present application claims priority to and the benefit of Japanese Patent Application No. 2010-137870, which was filed on Jun. 17, 2010, the disclosure of which is incorporated herein by reference in its entirety.

BACKGROUND OF THE INVENTION

1. Field of the Invention

The present invention relates to liquid cartridges configured to be mounted to a main body of a liquid ejecting apparatus, such as an ink cartridge for an ink-jet printer 2. Description of Related Art A known ink-jet printer, such as an ink-jet printer described in JP-A-2001-071522, comprises a printer main body and an ink cartridge configured to be removably mounted to the printer main body. The ink cartridge comprises two joint portions configured to selectively communicate an interior and an exterior of the ink cartridge for supplying ink to the printer main body, and a wall extending around the joint portions. The wall comprises a key groove for preventing erroneous mounting of the ink cartridge to the printer main body and a memory medium configured to store information relating to the cartridge.

The two joint portions protrude from the ink cartridge further than the wall, and the joint portions comprise resilient members, respectively. Accordingly, even when the ink cartridge falls with the joint portions facing downward and the joint portions come first into contact with a floor surface, the impact of the contact is absorbed by the resilient members. Accordingly, the likelihood that the wall is broken is reduced, and therefore the likelihood that the key groove and the memory medium is broken is reduced.

However, when the ink cartridge falls, the impact is exerted to the two joint portions intensively, breakage of the two joint portions or disassembly of components of the joint portions may be resulted. Because the joint portions are configured to communicate the interior and the exterior of the ink cartridge, if the joint portions are broken or disassembled, ink stored in the interior of the ink cartridge leaks to the exterior via the joint portions. Consequently, the periphery of the ink cartridge may be soiled with the ink.

SUMMARY OF THE INVENTION

Therefore, a need has arisen for liquid cartridges which overcome these and other shortcomings of the related art. A technical advantage of the invention is that when a liquid cartridge falls, an impact exerted to a communicating portion configured to communicate an interior and an exterior of the liquid cartridge is reduced.

In an embodiment of the invention, a liquid cartridge comprises a cartridge main body comprising a liquid chamber configured to store liquid therein and an end surface. The cartridge main body has a first side and a second side opposite from the first side in a width direction. The liquid cartridge also comprises a communicating portion protruding from the end surface of the cartridge main body in a protruding direction which is perpendicular to the width direction and configured to supply liquid from an interior of the liquid chamber to an exterior of the liquid chamber. The liquid chamber comprises a wide portion and a narrow portion which is narrower than the wide portion in the width direction, and the narrow portion is offset toward the first side of the cartridge main body in the width direction. When the liquid cartridge is oriented such that the communicating portion faces downward and liquid is stored in the narrow portion, a position of center of gravity of the liquid cartridge is offset toward the first side of the cartridge main body from an area occupied by the communicating portion when the liquid cartridge is viewed in a vertical direction.

Other objects, features, and advantages will be apparent to persons of ordinary skill in the art from the following detained description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawings.

DETAILED DESCRIPTION OF EMBODIMENTS OF THE INVENTION

Embodiments of the present invention, and their features and advantages, may be understood by referring to FIGS. 1-11, like numerals being used for like corresponding parts in the various drawings.

Figure 1:
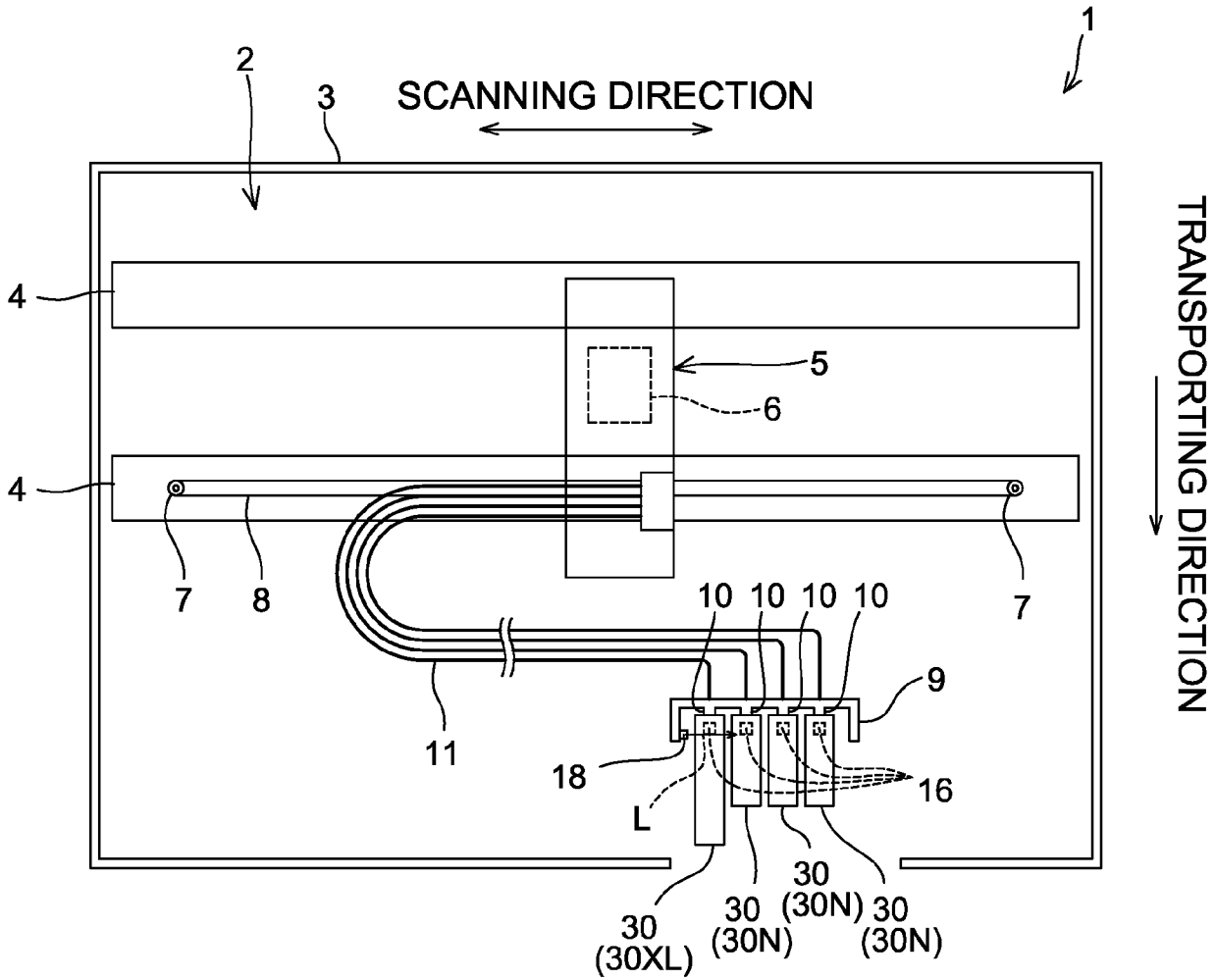
FIG. 1 is a schematic plan view of an ink-jet printer comprising an ink cartridge according to an embodiment of the invention.

Referring to FIG. 1, an ink-jet printer 1 comprises a printer main body 2 configured to print images on paper (not shown) by ejecting ink thereon, and plural (four, for example) ink cartridges 30 configured to removably mounted to the printer main body 2. The ink cartridges 30 have inks in colors different from each other (for example, black, magenta, yellow, and cyan) stored therein and serve as ink supply sources of the printer main body 2.

The printer main body 2 comprises a pair of guide rails 4 extending in a horizontal scanning direction, and a carriage 5 is supported by the guide rails 4. The printer main body 2 comprises an ink-jet head 6 configured to eject ink downward and mounted on the lower side of the carriage 5. The printer main body 2 comprises a pair of pulleys 7 provided at both ends of one of the pair of guide rails 4 respectively, and the carriage 5 is fixed to a belt 8 wound around the pulleys 7. When one of the pulleys 7 is driven by a motor (not shown) and rotated, the belt 8 runs around the pair of pulleys 7, and the carriage 5 is moved in the scanning direction, guided by the guide rails 4.

The printer main body 2 comprises a housing 3 and a cartridge mounting portion 9 provided inside the housing 3, and the cartridge mounting portion 9 is configured to receive the plural ink cartridges 30. The cartridge mounting portion 9 defines plural mounting spaces arranged in the scanning direction, and the ink cartridges 30 are configured to removably mounted to the mounting spaces, respectively. The cartridge mounting portion 9 comprises plural ink draw-out portions 10 corresponding to the respective mounting spaces, such that ink stored in the ink cartridges 30 mounted in the cartridge mounting portion 9 can be drawn out to the ink draw-out portions 10. The printer main body 2 comprises flexible ink supply tubes 11. One end of each of the flexible ink supply tubes 11 is connected to a corresponding one of the ink draw-out portions 10, and the other end of each of the ink supply tubes 11 is connected to the carriage 5.

The printer main body 2 is configured to transport a sheet of paper below the ink-jet head 6 in a horizontal transporting direction, which is perpendicular to the scanning direction. The printer main body 2 is configured to print an image on the sheet of paper by causing the ink-jet head 6 to eject ink downward onto the sheet of paper while reciprocating the carriage 5 in the scanning direction. As ink is consumed by the printer main body 2, ink stored in the ink cartridges 30 is supplied to the ink-jet head 6 mounted on the carriage 5 via the ink draw-out portions 10 and the ink supply tubes 11.

When the ink cartridges 30 becomes almost empty of ink, the ink cartridge 30 is replaced with new ink cartridges 30 having full of ink stored therein by a user. The user can mount the ink cartridges 30 to the cartridge mounting portion 9 by inserting the ink cartridge 30 into a corresponding one of the corresponding mounting spaces in an insertion direction which is parallel to the transporting direction. The user can also remove the ink cartridges 30 from the cartridge mounting portion 9 by pulling out the ink cartridges 30 in a direction opposite from the insertion direction. The insertion direction is a horizontal direction.

A normal cartridge 30N and a large cartridge 30XL having outer dimensions larger than the normal cartridge 30N and having a larger ink capacity than the normal cartridge 30N are selectively mounted to the same mounting space of the cartridge mounting portion 9. The large cartridge 30XL is longer than the normal cartridge 30N in the insertion direction. The amount of ink stored in the new large cartridge 30XL is larger than the amount of ink stored in the new normal cartridge 30N.

The cartridge mounting portion 9 comprises a mount sensors 16 and a remaining amount sensor 18 positioned in each of the mounting spaces. The mount sensor is used for detecting whether or not the ink cartridge 30 is mounted in the corresponding one of the mounting spaces of the cartridge mounting portion 9, and the remaining amount sensor 18 is used for detecting a near-empty state of the ink cartridge 30 mounted in the corresponding one of the mounting spaces (i.e., for detecting whether or not the ink cartridge 30 is almost empty or whether or not the remaining amount of ink stored in the ink cartridge 30 is almost zero). These sensors 16 and 18 are electrically connected to a controller (not shown) of the printer main body 2 and the controller is electrically connected to a display device (not shown) provided on an outer surface of the housing 3. When a signal indicating that the ink cartridges 30 is not mounted in the mounting space of the cartridge mounting portion 9 is supplied from the mount sensor 16 to the controller, the controller causes the display device to display as such to encourage the user to mount the ink cartridge 30. When a signal indicating the near-empty state of the ink cartridges 30 is almost empty (the remaining amount of ink is almost zero) is supplied from the remaining amount sensor 18 to the controller, the controller causes the display device to display that the ink cartridge 30 is in the near-empty state (the remaining amount of the ink is almost zero) to encourage the user to replace the ink cartridge 30 immediately or after a predetermined amount of ink is further consumed.

The mount sensor 16 is a contact sensor. In other words, different signals are supplied to the controller depending on whether an actuator of the mount sensor 16 is operated in contact with the ink cartridges 30 or not operated. The remaining amount sensor 18 is an optical sensor comprising a light-emitting portion configured to emit an inspection light L such as visible light or infrared light in the scanning direction and a light-receiving portion configured to receive the inspection light L emitted from the light-emitting portion. The light-receiving portion supplies different signals to the controller depending on whether or not it receives the inspection light L or not. Because FIG. 1 is a schematic view, and only a light-emitting portion of one remaining amount sensor 18 is shown. However, although not shown, the remaining amount sensors 18, each comprising the light-emitting portion and the light-receiving portion, are arranged in the cartridge mounting portion 9, corresponding to the ink cartridges 30 to be mounted to the cartridge mounting portion 9.

Figure 2:
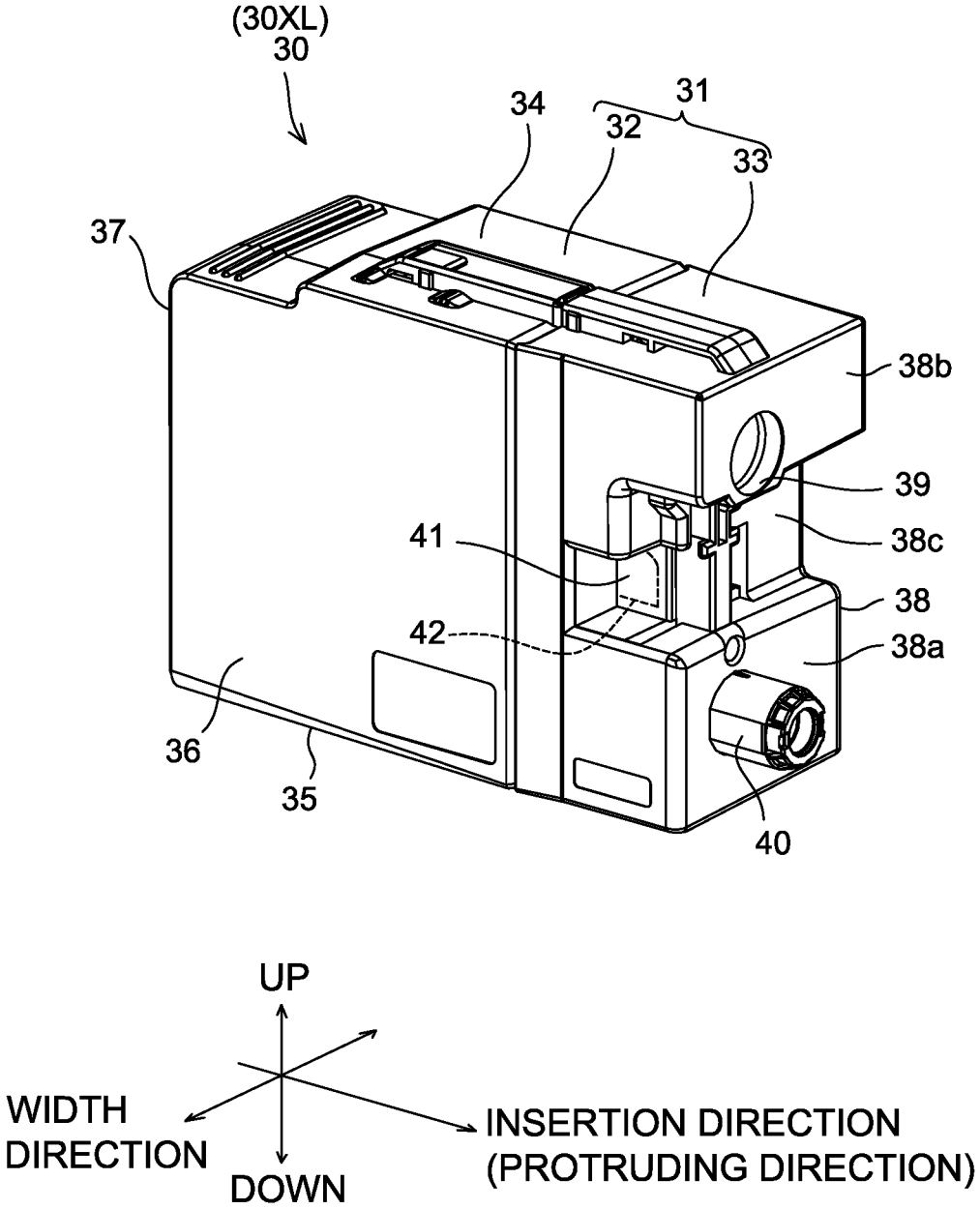
FIG. 2 is a perspective view of the ink cartridge.

Referring to FIG. 2, out of the normal cartridge 30N and the large cartridge 30XL, the large cartridge 30XL will be described as an example of the ink cartridge 30. As shown in FIG. 2, the ink cartridge 30 comprises a cartridge main body 31 comprising ink storage member 50 comprising an ink chamber 52 (see FIG. 3) configured to store ink therein, and two casing members 32 covering the ink storage member 50.

Two casing members 32 and 33 provide an outer shape of the ink cartridge main body 31, which has substantially a rectangular parallelepiped shape, and an outer surface of the ink cartridge main body 31 comprises an upper surface 34, a lower surface 35, a pair of side surfaces 36 (only one of them is shown in FIG. 2), an operation surface 37, and a connection surface 38. When the ink cartridge 30 is configured such that the ink cartridge 30 is inserted into the mounting space of the cartridge mounting portion 9 in the insertion direction with the operation surface 37 facing a user, i.e., facing an exterior of the cartridge mounting portion 9, the upper surface 34 facing upward, the lower surface 35 facing downward, and the connection surface 38 facing an inner end of the cartridge mounting portion 9, respectively. When the ink cartridge 30 is mounted in the cartridge mounting portion 9, the upper surface 34 and the lower surface 35 are apart from each other in the vertical direction, and overlapped with each other in the vertical direction. The pair of side surfaces 36 are apart from each other in the scanning direction and overlapped with each other in the scanning direction. The operation surface 37 and the connection surface 38 are apart from each other in the insertion direction and overlapped with each other in the insertion direction. The direction in which the pair of side surfaces 36 are apart from each other is also referred to as a width direction. The width direction and the insertion direction are perpendicular to each other. When the ink cartridge 30 is mounted in the cartridge mounting portion 9, each of the width direction and the insertion direction is on a horizontal plane and is perpendicular to the vertical direction.

The connection surface 38 comprises a lower portion 38*a*, an upper portion 38*b*, and an intermediate portion 38*c* positioned between the lower portion 38*a* and the upper portion 38*b* in the vertical direction. The intermediate portion 38*c* is recessed toward the operation surface 37 with respect to the lower portion 38*a* and the upper portion 38*b*. The upper portion 38*b* of the connection surface 38 comprises an atmospheric air communication portion 39 configured to communicate the ink chamber 52 of the cartridge main body 31 with the atmospheric air outside the cartridge main body 31. The atmospheric air communication portion 39 comprises a valve 39*a* (see FIG. 3) in the interior of the cartridge main body 31. The lower portion 38*a* of the connection surface 38 comprises an ink supply portion 40 configured to supply ink from the ink chamber 52 of the cartridge main body 31 to the printer main body 2, and the ink supply portion 40 protrudes from the lower portion 38*a* in a protruding direction. The protruding direction is aligned with the insertion direction, and is perpendicular to the width direction and the vertical direction.

When the ink cartridge 30 is mounted in the cartridge mounting portion 9 (see FIG. 1), the valve 39*a* (see FIG. 3) of the atmospheric air communication portion 39 is opened, the ink supply portion 40 is connected to the ink draw-out portion 10 (see FIG. 1), and a valve portion 102 (described later) of the ink supply portion 40 is opened. Accordingly, the interior of the cartridge main body 31 is brought into communication with the exterior of the cartridge main body 31, such that the ink chamber 52 of the cartridge main body 31 communicates with the atmospheric air, and ink stored in the ink chamber 52 can be supplied to the ink draw-out portion 10.

The intermediate portion 38*c* of the connection surface 38 comprises a translucent portion 41, and when the ink cartridge 30 is mounted in the cartridge mounting portion 9, the translucent portion 41 is positioned between the light-emitting portion and the light-receiving portion of the remaining amount sensor 18 (see FIG. 1) in the scanning direction (width direction) to receive the inspection light L from the remaining amount sensor 18. In the translucent portion 41, a light blocking panel 42*b* of a sensor arm 42 (described later, see FIG. 7) is positioned, and the sensor arm 42 is configured to pivot in association with lowering of an ink surface in the ink chamber 52 of the ink cartridge 30 due to the reduction in amount of the ink stored in the ink chamber 52. When a sufficient amount of ink is remained in the ink cartridge 30, the light blocking panel 42*b* of the sensor arm 42 stays in the translucent portion 41, and hence the inspection light L of the remaining amount sensor 18 is blocked by the light blocking panel 42*b*. Therefore, the light-receiving portion of the remaining amount sensor 18 does not receive the inspection light L. When ink stored in the ink cartridge 30 is reduced, such that the ink cartridge 30 becomes the near-empty state, and the ink surface is lowered to a predetermined height "he" (described later, see FIG. 7), the light blocking panel 42*b* of the sensor arm 42 moves upward out of the translucent portion 41, such that the inspection light L of the remaining amount sensor 18 passes through the translucent portion 41 to allow the light-receiving portion of the remaining amount sensor 18 to receive the inspection light L. Because signals output from the remaining amount sensor 18 are different depending on whether the light-receiving portion receives light or not, the controller is enabled to detect the near empty state, which is a state in which the ink cartridge 30 is almost empty of ink (a state in which the remaining amount of ink stored in the ink cartridge 30 is almost zero) according to the signals output from the remaining amount sensor 18.

Figure 3:
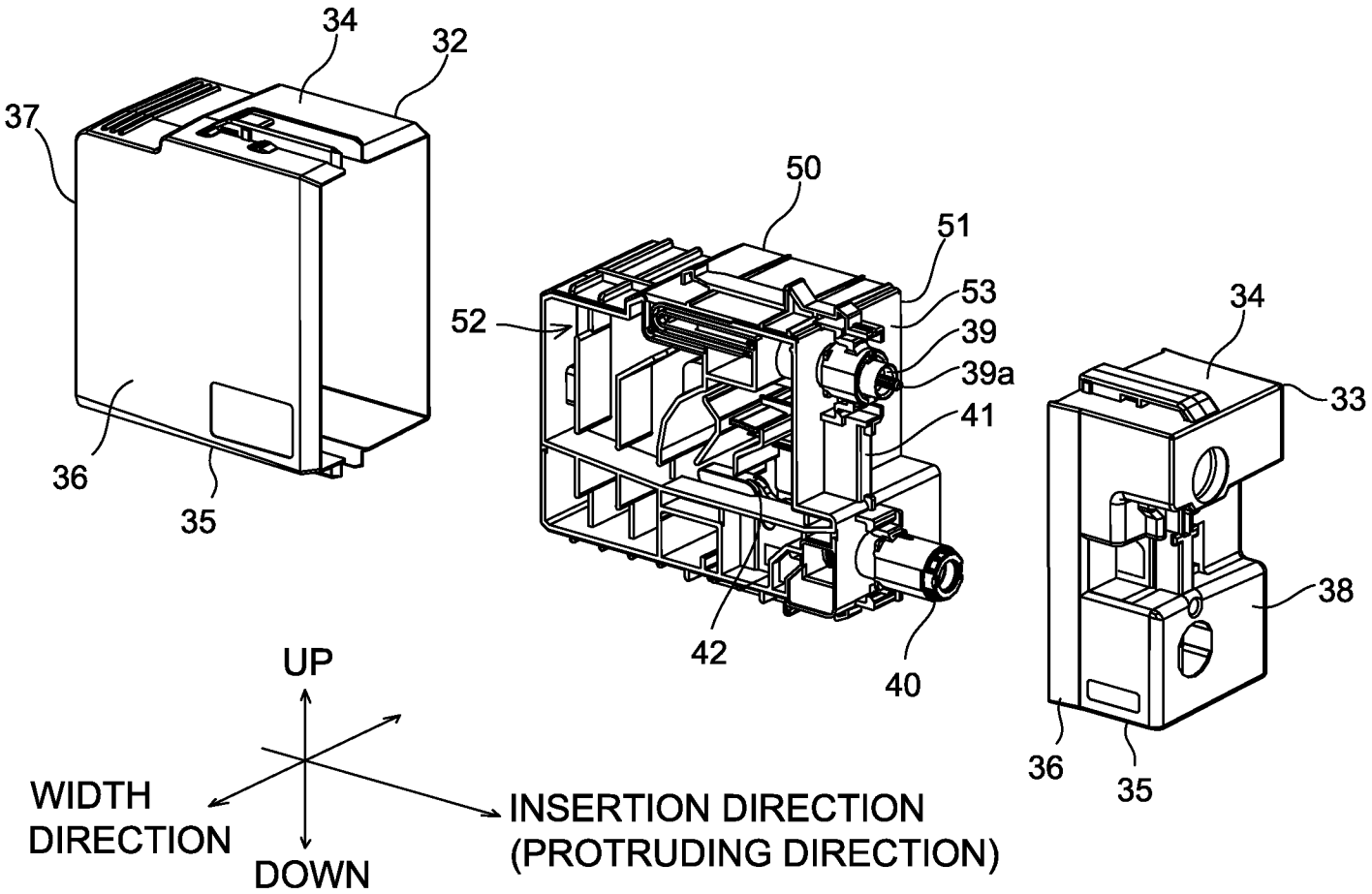
FIG. 3 is an exploded perspective view of the ink cartridge.

Referring to FIG. 3, the ink storage member 50 of the cartridge main body 31 comprises a frame portion 51 which defines the ink chamber 52 therein. The frame portion 51 has a substantially rectangular parallelepiped profile in side view, and end surfaces in the width direction are opened. In order to define the closed ink chamber 52 in the width direction, films (not shown) are connected, e.g., welded or adhered, to both sides of the frame portion 51 in the width direction.

The frame portion 51 comprises an end surface 53 facing forward in the insertion direction (protruding direction), and the atmospheric air communication portion 39 and the ink supply portion 40 protrude from the end surface 53 of the frame portion 51 in the insertion direction (protruding direction). The translucent portion 41 also protrudes from a vertical center portion of the end surface 53 in the same protruding direction as the ink supply portion 40. The translucent portion 41 is made of a transparent or semi-transparent material into a hollow flat parallelepiped shape. An inner space of the translucent portion 41 communicates with the ink chamber 52, and ink stored in the ink cartridge main body 31 can also be contained in the inner space of the translucent portion 41.

Figure 4:
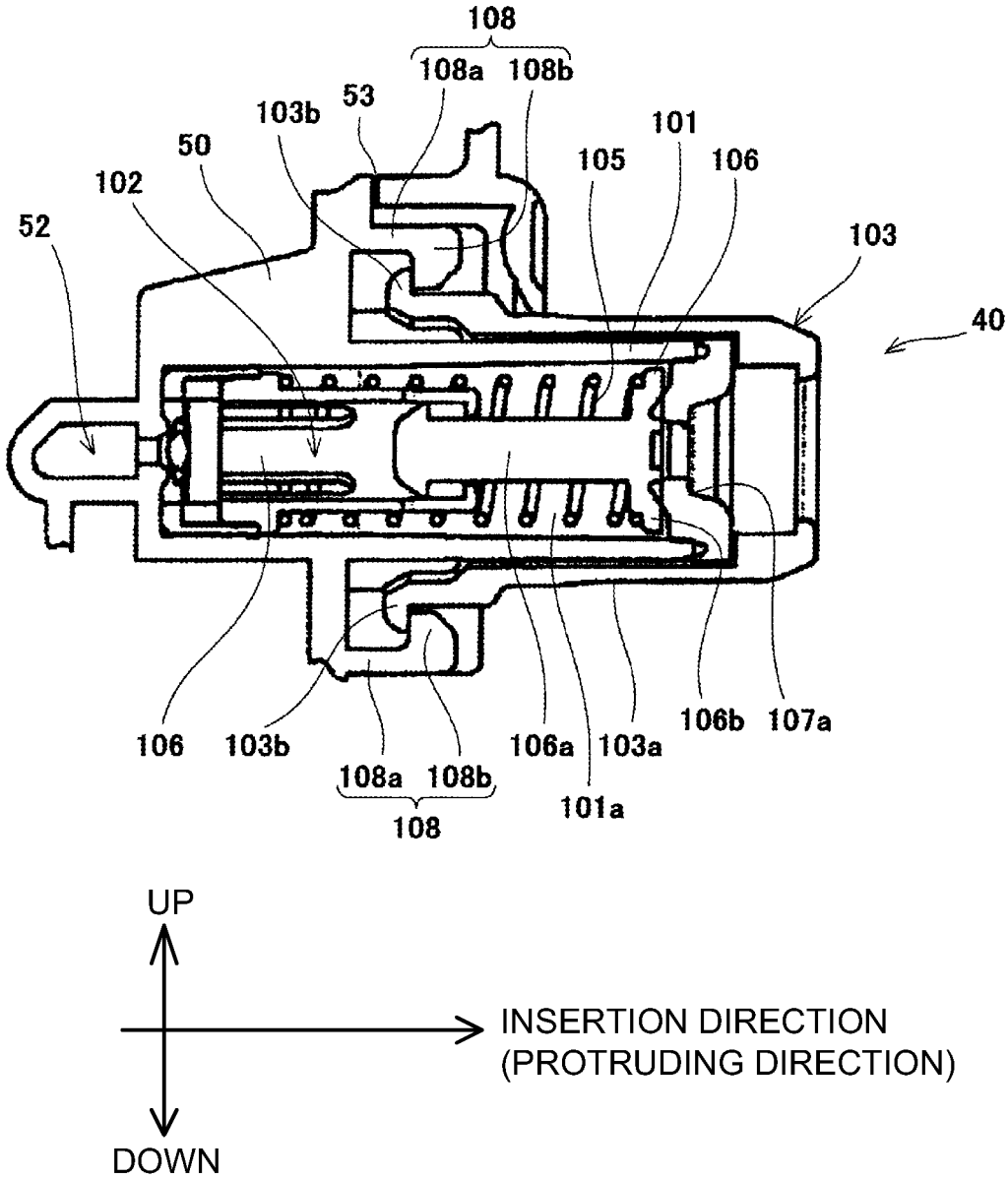
FIG. 4 is a cross-sectional view of an ink supply portion of the ink cartridge.

Referring to FIG. 4, the ink supply portion 40 comprises a cylindrical wall 101 protruding from the end surface 53 of the ink storage member 50 in the protruding direction. The ink supply portion 40 comprises a communicating opening 101*a* formed in the cylindrical wall 101 and extending from the ink chamber 52 toward the exterior of the ink storage member 50 in the protruding direction. The valve portion 102 of the ink supply portion 40 is positioned in the communicating opening 101*a*. The ink supply portion 40 comprises a cap member 103 positioned on the outer peripheral surface of the cylindrical wall 101.

Figures 5A, 5B:
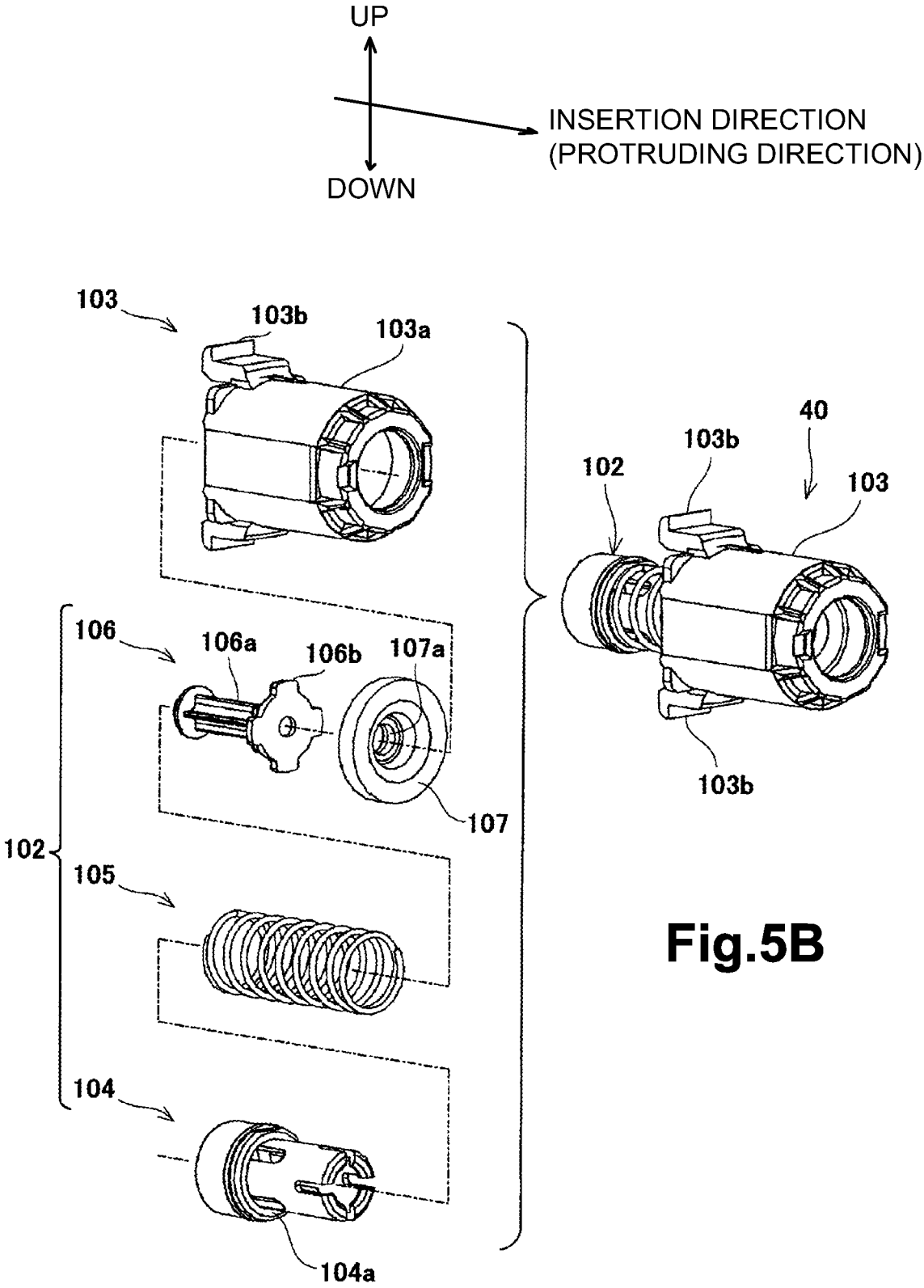
FIG. 5A is an exploded perspective view of the ink supply portion.
FIG. 5B is a perspective view of the ink supply portion which is assembled.

Referring to FIG. 5A, the valve portion 102 comprises a valve member 104, a coil spring 105, a cylinder 106, and a seal member 107. The valve member 104 is formed into a shouldered cylindrical shape, and the valve member 104 comprises a front portion in the protruding direction. Openings 104*a* for allowing ink to flow therethrough are formed through a peripheral wall of the front portion of the valve member 104. The coil spring 105 is fitted around the front portion of the valve member 104. The cylinder 106 comprises a rod-shaped cylinder body 106*a* and a contact plate 106*b* provided at a front end of the cylinder body 106*a* in the protruding direction. The cylinder body 106*a* is stored in the interior of the valve member 104 from the front side of the valve member 104 in the protruding direction. A rear side of the contact plate 106*b* in the protruding direction is in contact with an end of the coil spring 105. A front side of the contact plate 106*b* in the protruding direction is configured to come into contact with the cylindrical seal member 107. The seal member 107 is made of a resilient material and is positioned at an end of the cylindrical wall 101 in the protruding direction. An insertion opening 107*a* is formed through a center portion of the seal member 107. When the ink cartridge 30 is not mounted in the cartridge mounting portion 9 (see FIG. 1), the contact plate 106*b* is urged by the coil spring 105 in the protruding direction, such that the contact plate 106*b* comes into contact with the seal member 107, and thereby the insertion opening 107*a* is closed by the contact plate 106*b*. The valve portion 102 and the cylindrical wall 101 configured in this manner are fitted in the cap member 103, such that the valve portion 102 is retained in the communicating opening 101*a*. The cap member 103 comprises a cylindrical surrounding wall 103*a*, and a pair of engagement strips 103*b* positioned at a rear end portion of the surrounding wall 103*a* in the protruding direction. The pair of engagement strips 103*b* is positioned apart from each other by 180 degrees. The engagement strips 103*b* extend from an outer peripheral surface of the surrounding wall 103*a* in the vertical direction away from each other.

Returning back to FIG. 4, the ink storage member 50 comprises a pair of engagement claws 108 extending from the end surface 53 of the ink storage member 50 above and below the cylindrical wall 101, respectively. The engagement claw 108 comprises a first portion 108*a* extending from the end surface 53 forward in the protruding direction and a second portion 108*b* extending from the front end of the first portion 108*a* toward the cylindrical wall 101 in the vertical direction.

The valve member 104, the coil spring 105, and the cylinder 106, and a portion of the seal member 107 of the valve portion 102 are positioned in the communicating opening 101*a* of the cylindrical wall 101, the cap member 103 is fitted around the outer periphery of the cylindrical wall 101, and the pair of engagement strips 103*b* of the cap member 103 are engaged with the pair of engagement claws 108, respectively. More specifically, the first portion 108*a* of the engagement claw 108 extends in the protruding direction beyond the engagement strip 103*b*, and the second portion 108*b* of the engagement claw 108 is in contact with the engagement strip 103*b* while being positioned at the front of the engagement strip 103*b* in the protruding direction. Therefore, even when a force to pull the cap member 103 out of the cylindrical wall 101 in the protruding direction is applied to the cap member 103, the cap member 103 is prevented from coming apart from the cylindrical wall 101 by the contact between the engagement strips 103*b* and the second portions 108*b* of the engagement claws 108. An inner diameter of a front portion of the surrounding wall 103*a* of the cap member 103 in the protruding direction is smaller than inner diameters of other portions of the surrounding wall 103*a*, and is smaller than an outer diameter of the seal member 107. The seal member 107 is retained by being sandwiched between the front portion of the surrounding wall 103*a* and the cylindrical wall 101 while being resiliently deformed. The communicating opening 101*a* of the cylindrical wall 101 communicates with the front end of the ink chamber 52 in the insertion direction (protruding direction). When the valve portion 102 is stored in the communicating opening 101*a* of the cylindrical wall 101, the ink chamber 52 communicates also with the inner space of the valve member 104. When the ink cartridge 30 is not mounted to the cartridge mounting portion 9 (see FIG. 1), the contact plate 106*b* of the cylinder 106 is urged by the coil spring 105 and contacts the seal member 107 to close the insertion opening 107*a*. Therefore, ink stored in the communicating opening 101*a* does not leak from the cartridge main body 31 to the exterior of the cartridge main body 31. When the ink cartridge 30 is mounted in the cartridge mounting portion 9 (see FIG. 1), the contact plate 106*b* of the cylinder 106 is pressed in the direction opposite from the protruding direction against the urging force of the coil spring 105 by the ink draw-out portion 10 (see FIG. 1), such that the contact plate 106*b* moves apart from the seal member 107. Accordingly, the insertion opening 107*a* is released to communicate the ink chamber 52 with the exterior of the ink cartridge 30 via the communicating opening 101*a*, such that ink stored in the ink chamber 52 can be supplied to the exterior of the ink cartridge 30 via the communicating opening 101*a* and the insertion opening 107*a*.

Figure 6:
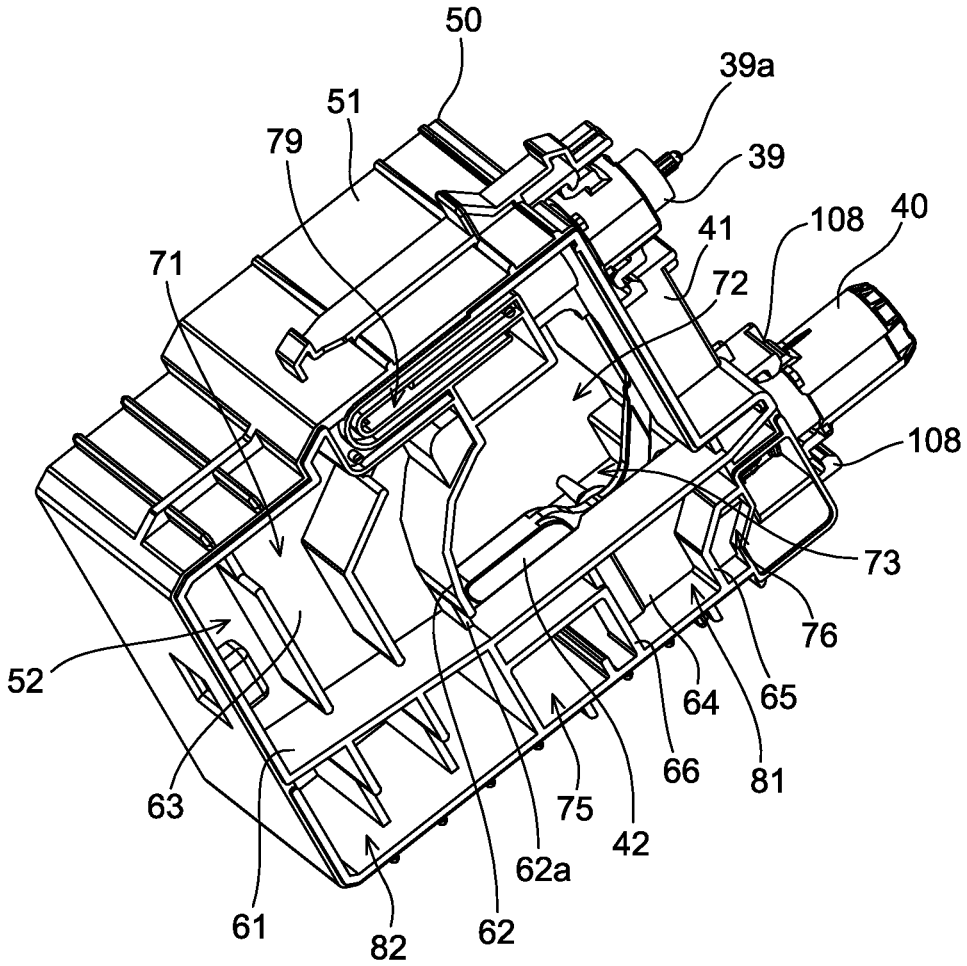
FIG. 6 is a perspective view of an ink storage member of the ink cartridge.
Figure 6:
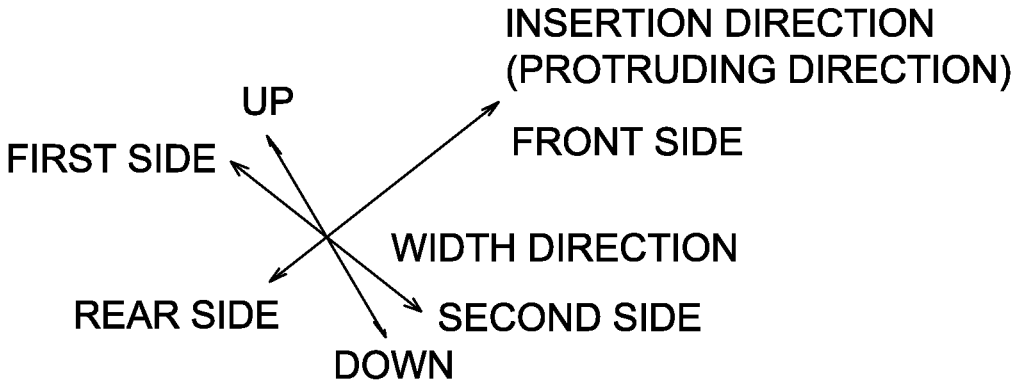
Figure 7:
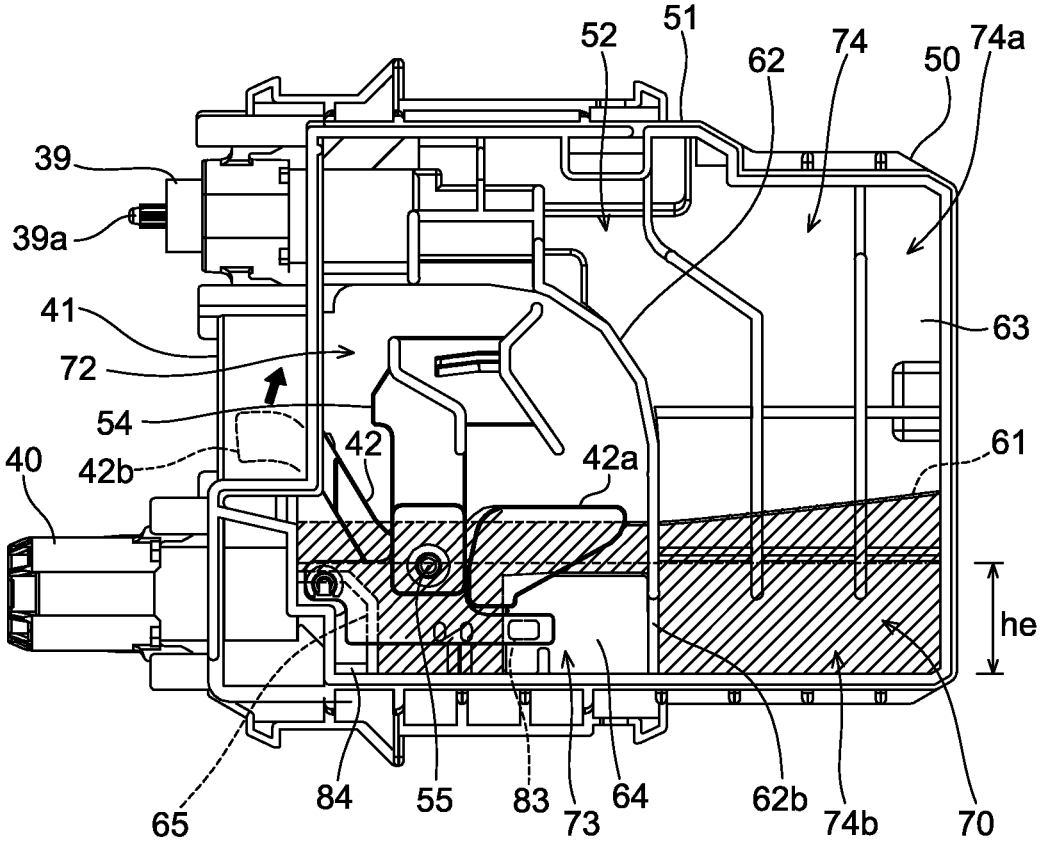
FIG. 7 is a side view of the ink storage member viewed from a first side in a width direction.
Figure 7:
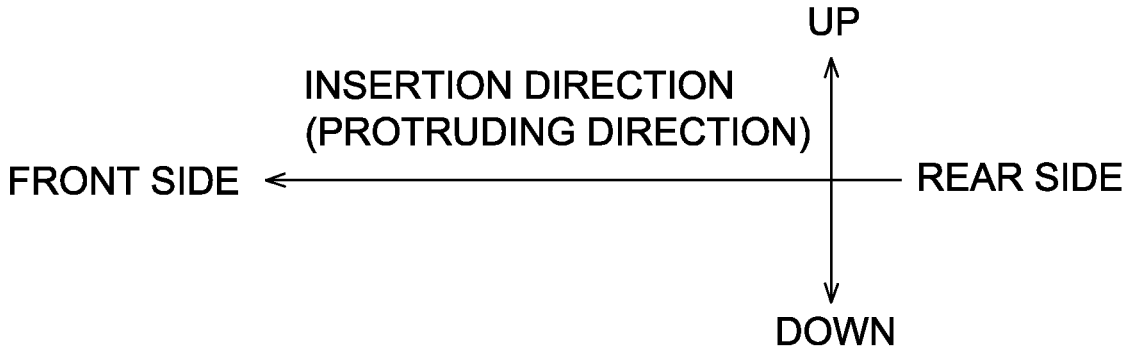
Figure 8:
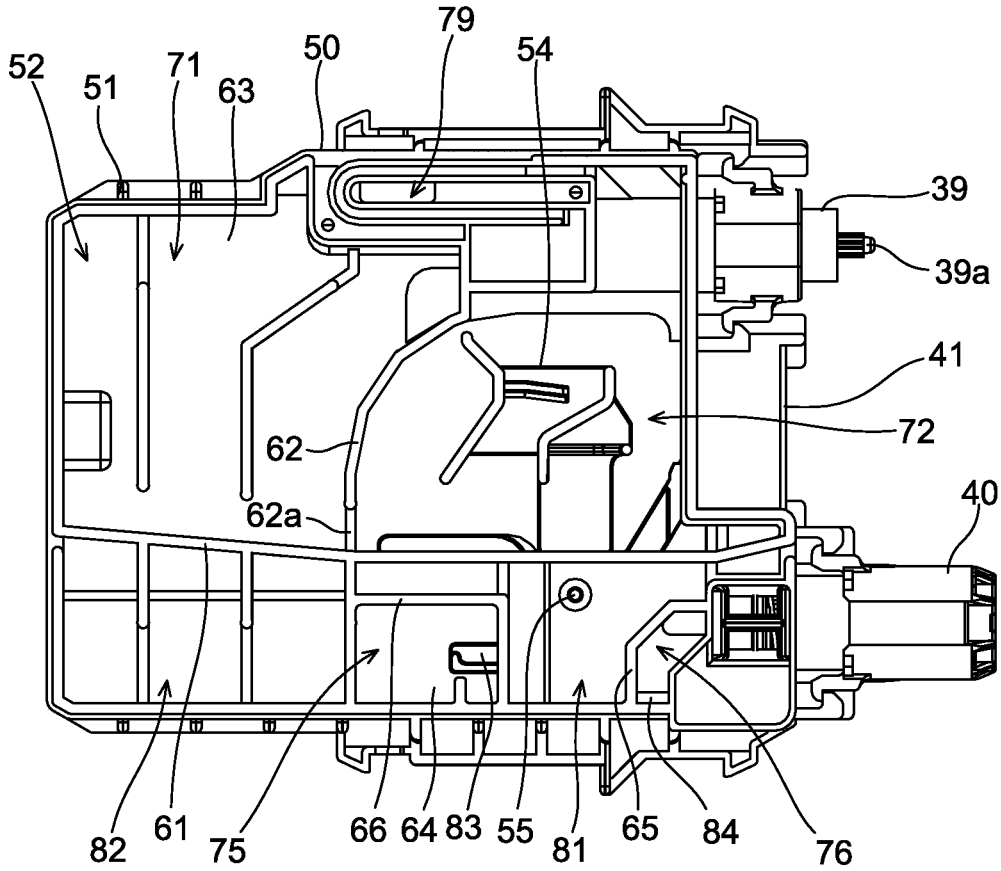
FIG. 8 is a side view of the ink storage member viewed from a second side in the width direction.
Figure 8:
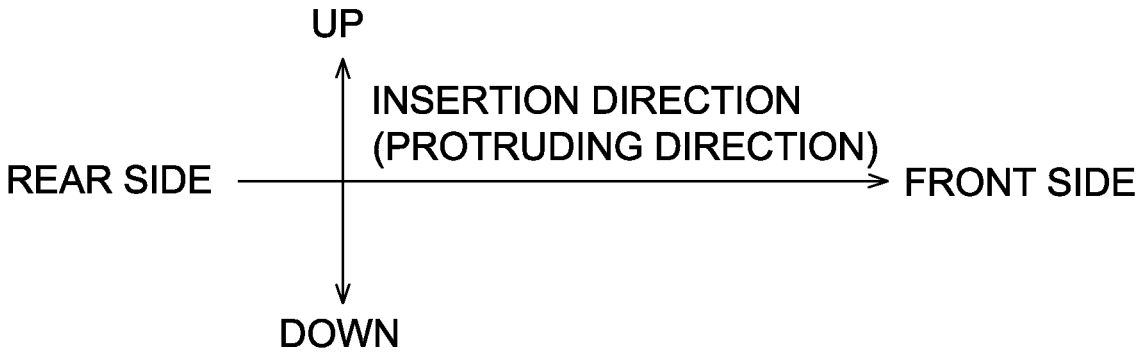

Referring to FIGS. 6 to 8, the ink storage member 50 comprises a first partitioning wall 61 positioned in the frame portion 51 and extending in the insertion direction (protruding direction) across the substantially entirely of the frame portion 51. The first partitioning wall 61 is positioned slightly below the center of the frame portion 51 with respect to the vertical direction. The cartridge main body 31 has a first side and a second side opposite from the first side in the width direction. A second-side end of the first partitioning wall 61 is connected to the film. However, a first-side end of the first partitioning wall 61 is positioned inward of the frame portion 51, and is not connected to the film.

The ink storage member 50 comprises a second partitioning wall 62 extending vertically, and the second partitioning wall 62 extending through the center portion of the first partitioning wall 61 50 with respect to the insertion direction (protruding direction). The second partitioning wall 62 extends across substantially entirely of the frame portion 51 in the width direction, and films are connected to both a first-side end and a second-side end of the second partitioning wall 62. The second partitioning wall 62 extends across substantially from the upper portion to the lower portion of the ink chamber 52. Therefore, the ink chamber 52 is divided by the second partitioning wall 62 into the rear side and the front side in the insertion direction (protruding direction).

The ink storage member 50 comprises a third partitioning wall 63 connected to a rear-side surface of the second partitioning wall 62. The third partitioning wall extends in parallel to the pair of side surfaces 36 (see FIG. 2) of the cartridge main body 31. The third partitioning wall 63 extends across the inside of the frame portion 51 entirely in the vertical direction, and a second-side surface of the third partitioning wall 63 is connected to the first-side end of the first partitioning wall 61. The ink chamber 52 comprises a first storage chamber 71 defined by the rear-side surface of the second partitioning wall 62 above the first partitioning wall 61 and the second-side surface of the third partitioning wall 63. An upper portion of the first storage chamber 71 is connected to the atmospheric air communication portion 39 via a labyrinth space 79.

The second partitioning wall 62 comprises a cut-out 62*a* formed therethrough at a second-side portion thereof above the first partitioning wall 61, whereby an upper surface of the first partitioning wall 61 continues in the insertion direction (protruding direction) without being blocked by the second partitioning wall 62. With the provision of the cut-out 62*a*, a second-side end of the second partitioning wall 62 where the cut-out 62*a* is formed is positioned inward of the frame portion 51, such that the film is not connected thereto. The ink chamber 52 comprises a second storage chamber 72 formed at the front of the second partitioning wall 62 in the insertion direction (protruding direction) above the first partitioning wall 61. The second storage chamber 72 communicates with the first storage chamber 71 via the cut-out 62*a*.

The ink storage member 50 comprises a fourth partitioning wall 64 extending downward from a first-side end of a front-side portion of the first partitioning wall 61 in the insertion direction (protruding direction). The fourth partitioning wall 64 extends in parallel to the third partitioning wall 63, and is connected to an inner bottom surface of the frame portion 51.

The ink chamber 52 comprises a third storage chamber 73 defined by the front-side surface of the second partitioning wall 62 in the insertion direction (protruding direction), the lower-side surface of the first partitioning wall 61, and the first-side surface of the fourth partitioning wall 64. The third storage chamber 73 communicates with the second storage chamber 72 in the vertical direction.

The second storage chamber 72 communicates with the inner space of the above-described translucent portion 41, and the sensor arm 42 is positioned so as to extend in the second storage chamber 72, the third storage chamber 73, and the inner space of the translucent portion 41.

The ink storage member 50 comprises a fifth partitioning wall 65 and a sixth partitioning wall 66 extending from a second-side surface of the fourth partitioning wall 64 toward the second side of the frame portion 51 in the width direction. The fifth partitioning wall 65 extends upward from the inner bottom surface of the frame portion 51. The sixth partitioning wall 66 extends upward from the inner bottom surface of the frame portion 51 at a substantially center of the fourth partitioning wall 64 with respect to the insertion direction (protruding direction), is then bent at an right angle at a position below the first partitioning wall 61, then extends toward the rear side in the insertion direction (protruding direction), and then is connected to the front-side surface of the second partitioning wall 62, which extends in the vertical direction. Second-side ends of the first partitioning wall 61, the second partitioning wall 62, the fifth partitioning wall 65, and the sixth partitioning wall 66 are connected to the film. Therefore, a first closed space 81 surrounded by a lower surface of the first partitioning wall 61, the front-side surface of the second partitioning wall 62, the second-side surface of the fourth partitioning wall 64, the inner bottom surface of the frame portion 51, the fifth partitioning wall 65, and the sixth partitioning wall 66 is formed in the interior of the cartridge main body 31.

A second closed space 82 surrounded by the lower surface of the first partitioning wall 61, the rear-side surface of the second partitioning wall 62, the second-side surface of the third partitioning wall 63, the inner bottom surface of the frame portion 51, and an inner rear surface of the frame portion 51 is formed in the interior of the cartridge main body 31. The first closed space 81 and the third storage chamber 73 are positioned side by side in the width direction with the fourth partitioning wall 64 positioned therebetween. Therefore, the first closed space 81 and the third storage chamber 73 is aligned in the width direction. The second closed space 82 and the first storage chamber 71 are positioned side by side in the vertical direction with the first partitioning wall 61 positioned therebetween. Therefore, the second closed space 82 and the first storage chamber 71 are aligned in the vertical direction.

Referring to FIG. 7, the ink chamber 52 comprises a fourth storage chamber 74 defined by the rear-side surface of the second partitioning wall 62 and the first-side surface of the third partitioning wall 63. A cut-out 62*b* is formed through a lower end portion of the second partitioning wall 62 at the first-side portion of the second partitioning wall 62. Therefore, the third storage chamber 73 communicates with the fourth storage chamber 74 via the cut-out 62*b*. FIG. 7 shows a portion of the first partitioning wall 61 with a dotted line, which portion is positioned on the back side (on the second side) of the third partitioning wall 63 and at the rear of the second partitioning wall 62. The fourth storage chamber 74 comprises an upper portion 74*a* positioned above the first partitioning wall 61 and a lower portion 74*b* positioned below the first partitioning wall 61. The upper portion 74*a* of the fourth storage chamber 74 and the first storage chamber 71 (see FIG. 6) are arranged side by side in the width direction with the third partitioning wall 63 positioned therebetween. Therefore, the upper portion 74*a* of the fourth storage chamber 74 and the first storage chamber 71 are aligned in the width direction. The lower portion 74*b* of the fourth storage chamber 74 and the second closed space 82 (see FIG. 6) are arranged side by side with the third partitioning wall 63 positioned therebetween. Therefore, the lower portion 74*b* of the fourth storage chamber 74 and the second closed space 82 are aligned in the width direction. Because the lower portion of the third partitioning wall 63 does not have any openings formed therethrough, ink is not stored in the second closed space 82.

Referring to FIG. 8, the ink chamber 52 comprises a fifth storage chamber 75 defined by a surface of the sixth partitioning wall 66 on the side opposite from the side which defines the first closed space 81, the front-side surface of the second partitioning wall 62, the second-side surface of the fourth partitioning wall 64, and the inner bottom surface of the frame portion 51. This fifth storage chamber 75 communicates with the third storage chamber 73 (see FIG. 7) via an opening 83 formed through the fourth partitioning wall 64.

The ink chamber 52 comprises a sixth storage chamber 76 defined by a surface of the fifth partitioning wall 65 on the side opposite from the side which defines the first closed space 81, and the inner bottom surface of the frame portion 51. This sixth storage chamber 76 communicates with the third storage chamber 73 (see FIG. 7) via an opening 84 formed through the fourth partitioning wall 64. The sixth storage chamber 76 is positioned at the front end of the frame portion 51 in the insertion direction (protruding direction), and communicates with the communicating opening 101*a* of the cylindrical wall 101 (see FIG. 4) in which the valve portion 102 of the ink supply portion 40 is stored. A portion of the fourth partitioning wall 64 which defines the first closed space 81 does not have any openings formed therethrough. Therefore, ink is not stored in the first closed space 81.

As shown in FIG. 7 and FIG. 8, the first closed space 81 and the second closed space 82 are offset toward the second side of the ink cartridge main body 31 in the width direction, and a portion of the third storage chamber 73 aligned with the first closed space 81 in the width direction and the lower portion 74*b* of the fourth storage chamber 74 which is aligned with the second closed space 82 in the width direction are offset toward the first side of the ink cartridge 30 in the width direction. This portion of the third storage chamber 73 and the lower portion 74*b* of the fourth storage chamber 74 portions constitute a narrow portion 70 (hatched area in FIG. 7) which is narrower than other portions of the ink chamber 52 in the width direction. Ink can be stored in the first storage chamber 71 and the upper portion 74*a* of the fourth storage chamber 74 across the substantially entire area of the frame portion 51 in the width direction with the third partitioning wall 63 positioned therebetween. Similarly, ink can be stored in the second storage chamber 72 across the substantially entire area of the frame portion 51 in the width direction. Similarly, ink can be stored in the fifth storage chamber 75 and a portion of the third storage chamber 73 which is aligned with the fifth storage chamber 75 in the width direction across the substantially entire area of the frame portion 51 in the width direction with the fourth partitioning wall 64 positioned therebetween. However, in the narrow portion 70, ink cannot be stored across the substantially entire area of the frame portion 51 in the width direction.

As shown in FIG. 7, the ink storage member 50 comprises a pin 55 protruding from the first-side surface of the fourth partitioning wall 64 direction toward the fist side of the frame portion 51 in the width direction. The sensor arm 42 is pivotably supported by the pin 55. An arm cover 54 is mounted to a first-side end portion of the pin 55 so as to prevent the sensor arm 42 mounted on the pin 55 from coming apart from the pin 55 (illustration of the arm cover is omitted in FIG. 3). The sensor arm 42 comprises a float 42*a* positioned at a first end thereof, which can float on the ink surface. The sensor arm 42 comprises the light blocking panel 42*b* positioned at a second end thereof, which is stored in the inner space of the translucent portion 41. When a remaining amount of ink is large in the ink chamber 52, the float 42*a* is submerged in the ink and the light blocking panel 42*b* is positioned in the translucent portion 41. When the remaining amount of ink in the ink chamber 52 is reduced and the ink surface in the ink chamber 52 is lowered, the float 42*a* is exposed from the ink surface and floats on the ink surface. When the remaining amount of ink is further reduced, the float 42*a* moves downward correspondingly. The light blocking panel 42*b* moves upward accordingly. When the height of the ink surface from the inner bottom surface of the frame portion 51 reaches the predetermined height "he", the light blocking panel 42*b* moves out of the translucent portion 41 into the second storage chamber 72, such that the inspection light L passes through the translucent portion 41 and the light-receiving portion of the remaining amount sensor 18 receives the inspection light L. When the light-receiving portion receives the inspection light L, the remaining amount sensor 18 (see FIG. 1) outputs a signal which indicates that the ink cartridge 30 becomes the near-empty state to the controller. In this embodiment, the predetermined height "he" is positioned in the narrow portion 70. Because a dimension of the narrow portion 70 in the width direction is small, a horizontal cross-sectional area of the narrow portion 70 is also small. Therefore, in the narrow portion 70, the ink surface is lowered highly responsively according to the reduction of the ink. Because the predetermined height "he", which is a threshold of whether or not the ink cartridge 30 is in the near-empty state, is positioned in the narrow portion 70, whether or not the ink cartridge 30 is in the near empty state can be detected with high degree of accuracy. How the sensor arm 42 is moved is described in US2008/0239033A1 and US2009058962A1 in more detail, for example.

Figure 9:
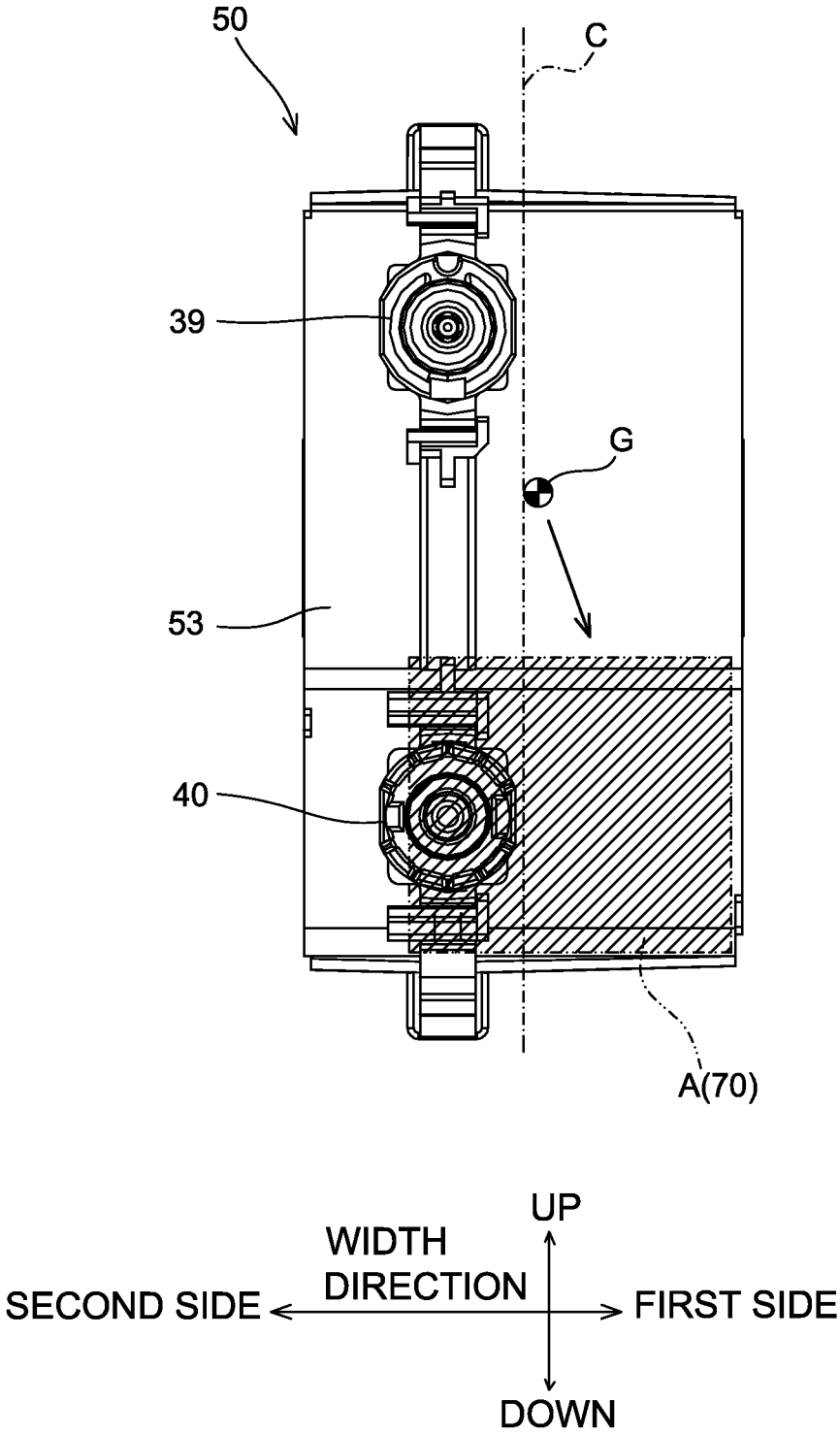
FIG. 9 is a front view of the ink storage member viewed from front in a protruding direction (i.e., from below in the vertical direction) when the ink cartridge is oriented such that the ink supply portion faces downward (i.e., the protruding direction is aligned with the vertical direction), in which an area occupied by a narrow portion and a position of center of gravity of the ink cartridge are shown. Ink is stored in the narrow portion.

As shown in FIG. 9, an area A occupied by the narrow portion 70 is offset toward the first side in the width direction. Therefore, when ink is stored in the narrow portion 70, the position of center of gravity G of the ink cartridge 30 is also offset toward the first side in the width direction. Therefore, the position of center of gravity G can be set at a position offset toward the first side in the width direction from a line C (hereinafter, referred to as a widthwise center line C) passing through the widthwise center of the connection surface 38 (or the end surface 53) and extending perpendicularly to the width direction. In this embodiment, the ink supply portion 40 is provided at a position off set toward the second side in the width direction. Therefore, the widthwise center line C is positioned between the ink supply portion 40 and the narrow portion 70, and between the ink supply portion 40 and the position of center of gravity G. Accordingly, the position of center of gravity G is offset toward the first side of the cartridge main body 31 in the width direction from an area occupied by the ink supply portion 40. The dimensions of the ink chamber 52 are set such that the position of center of gravity G is offset toward the first side of the cartridge main body 31 in the width direction from the area occupied by the ink supply portion 40 as long as the ink is stored in the narrow portion 70 irrespective of how much amount of ink is stored in the ink chamber 52.

Figure 10A:
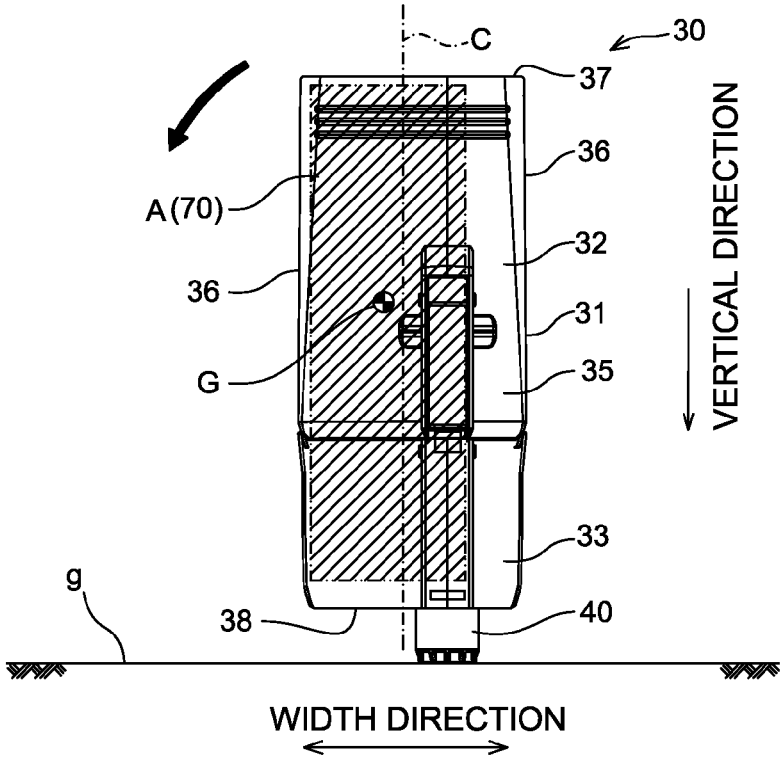
FIG. 10A is a side view of the ink cartridge falling onto a floor surface with the ink supply portion facing downward and contacting the floor surface.
Figure 10B:
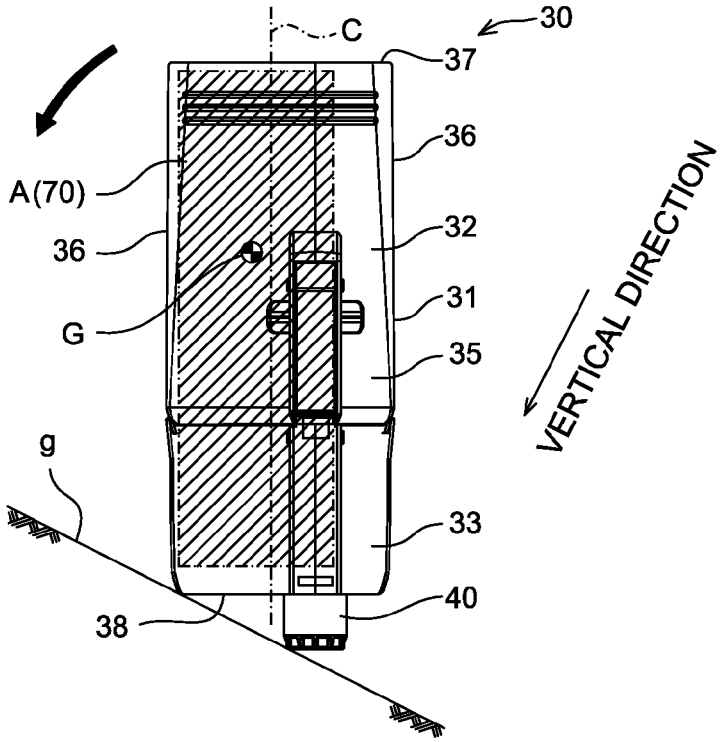
FIG. 10B is a side view of the ink cartridge in which the ink cartridge is rotated from the state shown in FIG. 10A and a cartridge main body contacts the floor surface.

Referring to FIGS. 10A and 10B, when the ink supply portion 40 faces downward, because at least a portion of the narrow portion 70 (a portion of the third storage chamber 73 aligned with the first closed space 81 in the width direction) is positioned at a position closer to the front end of the ink chamber 52 in the insertion direction (protruding direction), which communicates with the communicating opening 101*a* of the ink supply portion 40, than to the rear end of the ink chamber 52 in the insertion direction (protruding direction), ink can be stored in the narrow portion 70 even when the remaining amount of ink in the ink chamber 52 is small. As described above, when ink is stored in the narrow portion 70, the position of center of gravity G is offset toward the first side in the width direction.

When the ink cartridge 30 falls with the ink supply portion 40 facing downward, a front end portion of the ink supply portion 40 in the protruding direction comes into contact firstly with the floor surface "g" as shown in FIG. 10A. Subsequently, as shown in FIG. 10B, the ink cartridge 30 rotates about a contact point between the ink supply portion 40 and the floor surface "g" as a center of rotation in a direction such that the position of center of gravity G of the ink cartridge 30 moves downward, i.e., in a direction such that first side of the ink cartridge 30 in the width direction faces downward, and hence a corner between the connection surface 38 and the side surface 36 of the cartridge main body 31 of the ink cartridge 30 comes into contact with the floor surface "g". Therefore, the impact of the contact exerted on the ink supply portion 40 is reduced.

In this embodiment, because the ink supply portion 40 is at the position offset toward the second side opposite from the first side toward which the narrow portion 70 is offset with respect to the widthwise center line C as described above, the position of center of gravity G can be kept apart in the width direction from the area occupied by the ink supply portion 40 viewed in the vertical direction when the ink supply portion 40 faces downward.

In this embodiment, the pair of the engagement claws 108 is provided on the cartridge main body 31 at positions apart from each other in the vertical direction, and the pair of engagement strips 103*b* provided on the ink supply portion 40 is engaged with the engagement claws 108, respectively. The engagement strips 103*b* extend from the surrounding wall 103*a* in the vertical direction, and are in contact with the second portions 108*b* of the engagement claws 108 in the protruding direction. Therefore, even when the ink cartridge 30 falls and the ink cartridge 30 is rotated due to the contact between the ink supply portion 40 and the floor surface "g" as described above, the direction in which the engagement strips 103*b* extend from the surrounding wall 103*a* is perpendicular to the direction of rotation, such that a rotational force does not act on the engagement strips 103*b* and hence the engagement strips 103*b* are prevented from becoming damaged. That is, the damage of the ink supply portion 40 can be reduced. If engagement strips extended from the surrounding wall in the width direction, the rotational force is exerted on the engagement strips, such that the engagement strips may be broken.

In the description given above, the large cartridge 30XL has been described as a representative of the ink cartridge 30. The description of the normal cartridge 30N is omitted because the normal cartridge 30N has the same configuration as the large cartridge 30XL except that the dimension of the ink cartridge main body 31 in the insertion direction is smaller than the dimension of the large cartridge 30XL in the insertion direction.

Figure 11:
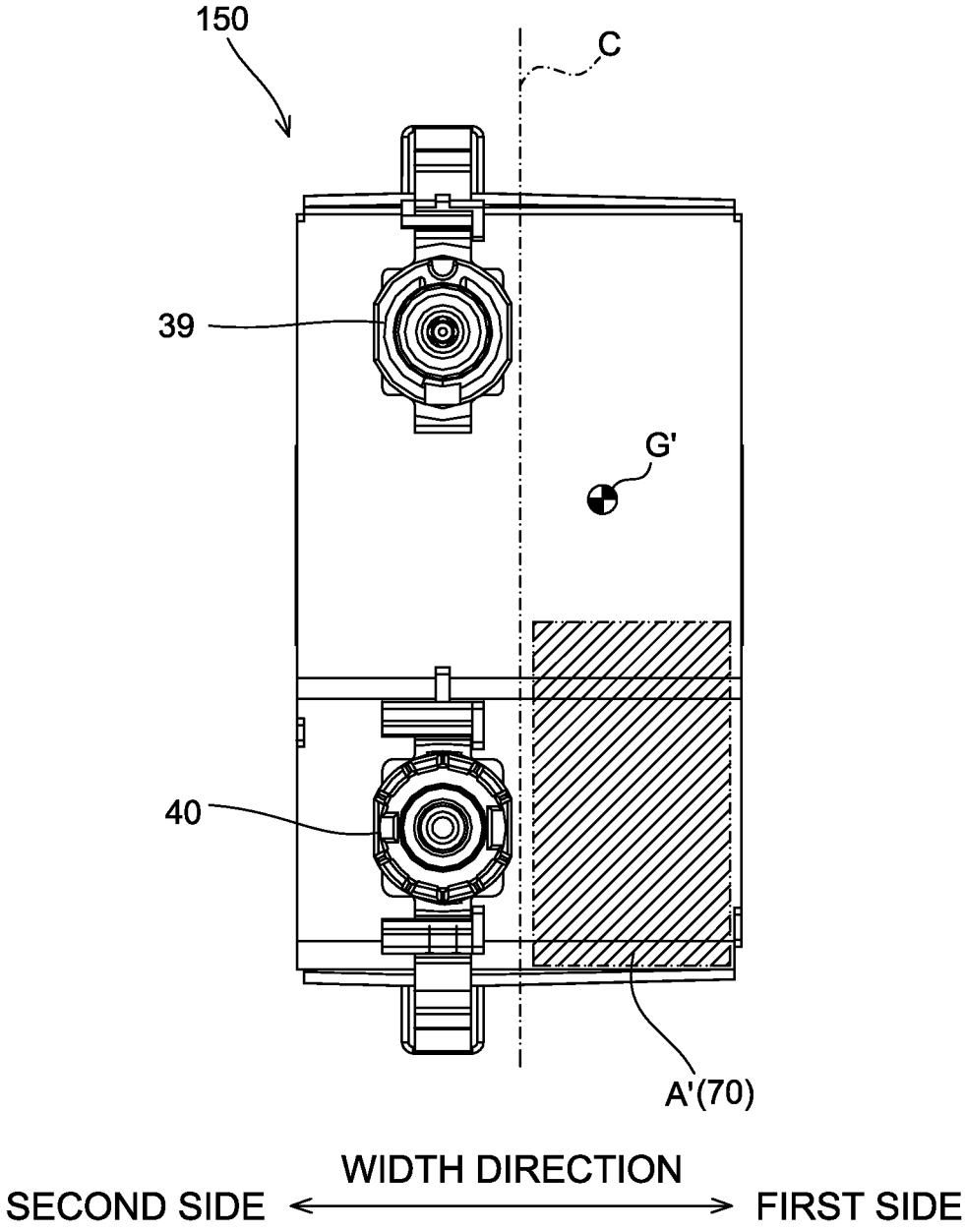
FIG. 11 is a front view of an ink storage member of an ink cartridge according to a modified embodiment, viewed from front in the protruding direction (i.e., from below in the vertical direction) when the ink cartridge is oriented such that the ink supply portion faces downward (i.e., the protruding direction is aligned with the vertical direction), in which an area occupied by a narrow portion and a position of center of gravity of the ink cartridge are shown. Ink is stored in the narrow portion.

Referring to FIG. 11, an ink storage member 150 of an ink cartridge according to a modified embodiment will be described. When the ink supply portion 40 faces downward, an area A' occupied by the narrow portion 70 is not overlapped with the area occupied by the ink supply portion 40. Accordingly, when ink is stored in the narrow portion 70, the position of center of gravity G can be at a position further offset toward the first side toward which the narrow portion 70 is offset. Moreover, the position of center of gravity G can be at a position further offset from the area occupied by the ink supply portion 40. Therefore, when the ink cartridge 30 falls and the ink supply portion 40 and the floor surface "g" come into contact with each other as described above, the ink cartridge 30 can rotate further easily, and hence the impact of contact exerted on the ink supply portion 40 is further reduced.

While the invention has been described in connection with various example structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. A liquid cartridge comprising:

a cartridge main body comprising a liquid chamber configured to store liquid therein and an end surface, wherein the cartridge main body has a first side and a second side opposite from the first side in a width direction; and a liquid supply portion protruding from the end surface of the cartridge main body in a protruding direction which is perpendicular to the width direction and configured to supply liquid from an interior of the liquid chamber to an exterior of the liquid chamber, wherein the liquid chamber comprises a wide portion and a narrow portion which is narrower than the wide portion in the width direction, and the narrow portion is offset toward the first side of the cartridge main body in the width direction, and wherein, when the liquid cartridge is oriented such that the liquid supply portion faces downward in a direction of gravity and liquid is stored in the narrow portion, a position of a center of gravity of the liquid cartridge is offset in the width direction toward the first side of the cartridge main body from an area occupied by the liquid supply portion when the liquid cartridge is viewed in a vertical direction.

2. The liquid cartridge of claim 1, wherein, when the liquid cartridge is oriented such that the liquid supply portion faces downward in the direction of gravity, an area occupied by the narrow portion is offset in the width direction from the area occupied by the liquid supply portion and is not overlapped with the area occupied by the liquid supply portion when the liquid cartridge is viewed in the vertical direction.

3. The liquid cartridge of claim 1, wherein the cartridge main body comprises a closed space formed therein, and no liquid is stored in the closed space, wherein the closed space and the narrow portion are aligned in the width direction.

4. The liquid cartridge of claim 1, wherein the liquid chamber comprises a first end and a second end opposite from the first end in a direction parallel to the protruding direction, the liquid supply portion comprises a communicating opening extending from the first end of the liquid chamber to an exterior of the liquid cartridge in the protruding direction, and at least a portion of the narrow portion is positioned closer to the first end of the liquid chamber than to the second end of the liquid chamber.

5. The liquid cartridge of claim 1, wherein the liquid cartridge is configured to be mounted to a main body of a liquid ejecting apparatus, and the width direction is aligned with a horizontal direction when the liquid cartridge is mounted in the main body of the liquid ejecting apparatus, the liquid cartridge further comprises a remaining amount detection member configured to cause the main body of the liquid ejecting apparatus to detect a near-empty state of the liquid cartridge when the liquid cartridge is mounted in the main body of the liquid ejecting apparatus and a liquid surface in the liquid chamber lowers and reaches a predetermined height, and the predetermined height is positioned in the narrow portion.

6. The liquid cartridge of claim 1, wherein the end surface has a center in the width direction, and a line passing through the center of the end surface and extending perpendicularly to the width direction is positioned between a center of the liquid supply portion and a center of the narrow portion in the width direction.

7. A liquid cartridge comprising:

a cartridge main body comprising a liquid chamber configured to store liquid therein and an end surface, wherein the cartridge main body has a first side and a second side opposite from the first side in a width direction; and a liquid supply portion protruding from the end surface of the cartridge main body in a protruding direction which is perpendicular to the width direction and configured to supply liquid from an interior of the liquid chamber to an exterior of the liquid chamber, wherein the liquid chamber comprises a wide portion and a narrow portion which is narrower than the wide portion in the width direction, and the narrow portion is offset toward the first side of the cartridge main body in the width direction, when the liquid cartridge is oriented such that the liquid supply portion faces downward and liquid is stored in the narrow portion, a position of a center of gravity of the liquid cartridge is offset toward the first side of the cartridge main body from an area occupied by the liquid supply portion when the liquid cartridge is viewed in a vertical direction, wherein the liquid supply portion comprises:

a protruding wall protruding from the one end surface of the cartridge main body in the protruding direction;

a communicating opening formed in the protruding wall and extending from the liquid chamber toward an exterior of the liquid cartridge in the protruding direction;

a blocking member positioned in the communicating opening and configured to selectively block and allow communication between the liquid chamber and the exterior of the liquid cartridge via the communicating opening; and a cap member configured to surround the protruding wall so as to retain the blocking member in the communicating opening, wherein the cap member comprises:

a surrounding wall surrounding the protruding wall and extending in the protruding direction; and an engagement strip extending from the surrounding wall in a direction away from the surrounding wall, wherein the cartridge main body comprises an engagement claw comprising:

a first portion extending from the end surface of the cartridge main body beyond the engagement strip in the protruding direction; and a second portion extending from a front end of the first portion in the protruding direction toward the cap member and contacting the engagement strip, and wherein a direction in which the engagement strip extends from the surrounding wall is perpendicular to the protruding direction and the width direction.

8. The liquid cartridge of claim 6, wherein an entire area occupied by the liquid supply portion is disposed offset from the line passing through the center of the end surface.

9. The liquid cartridge of claim 1, wherein the liquid supply portion comprises:

a protruding wall protruding from the one end surface of the cartridge main body in the protruding direction;

a communicating opening formed in the protruding wall and extending from the liquid chamber toward an exterior of the liquid cartridge in the protruding direction; and a blocking member positioned in the communicating opening and configured to selectively block and allow communication between the liquid chamber and the exterior of the liquid cartridge via the communicating opening.

10. A liquid cartridge comprising:

a cartridge main body comprising a liquid chamber configured to store liquid therein and an end surface, wherein the cartridge main body has a first side and a second side opposite from the first side in a width direction; and a liquid supply portion protruding from the end surface of the cartridge main body in a protruding direction which is perpendicular to the width direction and configured to supply liquid from an interior of the liquid chamber to an exterior of the liquid chamber, wherein the liquid chamber comprises a wide portion and a narrow portion which is narrower than the wide portion in the width direction, and the narrow portion is offset toward the first side of the cartridge main body in the width direction, when the liquid cartridge is oriented such that the liquid supply portion faces downward and liquid is stored in the narrow portion, a position of a center of gravity of the liquid cartridge is offset toward the first side of the cartridge main body from an area occupied by the liquid supply portion when the liquid cartridge is viewed in a vertical direction, wherein the liquid supply portion comprises:

a protruding wall protruding from the one end surface of the cartridge main body in the protruding direction;

a communicating opening formed in the protruding wall and extending from the liquid chamber toward an exterior of the liquid cartridge in the protruding direction; and a blocking member positioned in the communicating opening and configured to selectively block and allow communication between the liquid chamber and the exterior of the liquid cartridge via the communicating opening; and wherein the liquid cartridge further comprises:

a cap member configured to surround the protruding wall so as to retain the blocking member in the communicating opening, wherein the cap member comprises:

a surrounding wall surrounding the protruding wall and extending in the protruding direction; and an engagement strip extending from the surrounding wall in a direction away from the surrounding wall.

11. The liquid cartridge of claim 10, wherein the cartridge main body comprises an engagement claw comprising:

a first portion extending from the end surface of the cartridge main body beyond the engagement strip in the protruding direction; and a second portion extending from a front end of the first portion in the protruding direction toward the cap member and contacting the engagement strip.

12. The liquid cartridge of claim 10, wherein a direction in which the engagement strip extends from the surrounding wall is perpendicular to the protruding direction and the width direction.

* * * * *